US008651197B2

(12) United States Patent
Eisenhardt et al.

(10) Patent No.: US 8,651,197 B2
(45) Date of Patent: Feb. 18, 2014

(54) MANUALLY OPERATED HAMMER DRILL

(75) Inventors: Armin Eisenhardt, Bisingen (DE); Hans Klöpfer, Winnenden (DE)

(73) Assignee: AEG Electric Tools GmbH, Winnenden (DE)

( * ) Notice: Subject to any disclaimer, the term of this patent is extended or adjusted under 35 U.S.C. 154(b) by 298 days.

(21) Appl. No.: 13/015,648

(22) Filed: Jan. 28, 2011

(65) Prior Publication Data

US 2011/0186317 A1 Aug. 4, 2011

(30) Foreign Application Priority Data

Jan. 29, 2010 (DE) ..... 10 2010 006 152

(51) Int. Cl.
*E02D 7/06* (2006.01)

(52) U.S. Cl.
USPC ..... 173/48; 173/104; 173/109

(58) Field of Classification Search
USPC ..... 173/48, 47, 104, 109, 201; 92/84; 137/517; 251/900; 277/500
See application file for complete search history.

(56) References Cited

U.S. PATENT DOCUMENTS

| | | | | | |
|---|---|---|---|---|---|
| 2,420,104 | A | * | 5/1947 | Smith | 277/453 |
| 3,067,584 | A | | 12/1962 | Atkinson | |
| 3,353,454 | A | * | 11/1967 | Donovan | 92/5 R |
| 3,895,815 | A | | 7/1975 | Panigati | |
| 4,192,391 | A | | 3/1980 | Kastreuz et al. | |
| 4,418,924 | A | * | 12/1983 | Mack | 277/448 |
| 4,428,276 | A | * | 1/1984 | Loveless | 92/249 |
| 4,577,870 | A | * | 3/1986 | Scott et al. | 277/311 |
| 5,071,318 | A | * | 12/1991 | Bice et al. | 415/230 |
| 5,617,879 | A | * | 4/1997 | Kubala | 285/95 |
| 5,941,537 | A | * | 8/1999 | Wallace et al. | 277/642 |
| 6,237,699 | B1 | * | 5/2001 | Plietsch et al. | 173/201 |
| 7,331,408 | B2 | * | 2/2008 | Arich et al. | 173/201 |
| 7,815,195 | B2 | | 10/2010 | Meller et al. | |

FOREIGN PATENT DOCUMENTS

| | | | |
|---|---|---|---|
| DE | 2405176 | A1 | 8/1974 |
| DE | 2729596 | A1 | 1/1979 |
| DE | 10311155 | A1 | 9/2004 |
| DE | 60036244 | T2 | 6/2008 |
| DE | 102008061173 | A1 | 6/2010 |
| EP | 0152373 | A2 | 1/1985 |
| EP | 1027963 | A2 | 8/2000 |

OTHER PUBLICATIONS

European Search Report dated May 13, 2011.

* cited by examiner

*Primary Examiner* — Alexandra Elve
*Assistant Examiner* — Nathaniel Chukwurah
(74) *Attorney, Agent, or Firm* — Carlson, Gaskey & Olds, P.C.

(57) ABSTRACT

A manually operated hammer drill (1) includes a spindle (3) that drives a chuck (5) in a rotary manner about an axis of rotation (6) in a drilling mode, and includes a pneumatic hammer mechanism (4), that hammers against a tool inserted in the chuck (5) in a hammer mode. The hammer mechanism (4) has a piston (10) which performs reciprocating movements (12) parallel to the axis of rotation (6) in a cylinder (11) conformed inside the spindle (3) when hammer mode is activated. The piston (10) has at least one radial groove (21) in which an annular seal (22) is arranged.

15 Claims, 3 Drawing Sheets

MANUALLY OPERATED HAMMER DRILL

REFERENCE TO RELATED APPLICATION

This application claims priority to German Application No. 10 2010 006 152.2-14 filed on Jan. 29, 2010.

BACKGROUND

The present invention relates to a manually operated hammer drill.

A manually operated hammer drill usually includes a spindle which drives a chuck about an axis of rotation during drilling operations. The spindle itself is usually driven by an electric motor. Typically, such a hammer drill also includes a pneumatic hammer mechanism, which exerts a hammering action on the tool inserted in the chuck during hammer drilling operations. A hammer mechanism of such kind typically includes a piston, which in hammer mode moves back and forth parallel to the axis of rotation inside a cylinder formed in the spindle. The reciprocating movements of the piston are intended to create pulses of pressure inside the cylinder that cause an actuation piston to move back and forth as well, so that it strikes a percussion piston which in turn transfers these impacts to the respective tool. In order to be able to create these pressure pulses as effectively as possible, it is expedient to seal the piston off from the cylinder. For this purpose, the piston may be equipped with at least one radial groove in which an annular seal is disposed. This annular seal is prone to very rapid wear because of the reciprocating motion of the piston.

Modern hammer drills may also be equipped with a hammer action deactivation switch, which enables drilling to be performed without percussive action. To do this, for example, a powertrain between the spindle and the driving electric motor is interrupted, for example by means of a coupling or similar. When hammer mode is switched off, the piston does not execute any reciprocating movements in the cylinder. In drilling mode, the spindle rotates about the axis of rotation and thus also about the piston. When hammer mode is deactivated, this subjects the annular seal to particularly high stress. As a result, it may overheat and be damaged. A damaged annular seal reduces the sealing effect between the piston and the cylinder which in turn impairs the effectiveness of the pressure pulses in hammer mode and thus also the performance of the hammer drill.

SUMMARY

This disclosure relates to an improved design for a hammer drills that provides reduced wear.

The disclosed hammer drill provides for synchronising the radial groove and the annular seal in such manner that the annular seal is able to move parallel to the axis of rotation inside the radial groove, and the radial groove has a variable groove depth parallel to the axis of rotation. The sealing effect between the piston and the cylinder depends on the contact pressure exerted on the cylinder by the annular seal. The greater this radial pressing force, the greater the effective frictional forces as well. Because of the varying groove depth of the radial seal and the movability of the annular seal in the radial groove, the annular seal is able to assume a position where the groove is less deep when the piston is moving, so that the sealing effect is increased. As soon as the piston stops moving, for example when it travels through a dead point in the oscillating reciprocating movement, the annular seal is able to take up a position in which the groove depth is greater, so that friction may be reduced significantly. Consequently, wear on the annular seal in hammer mode may be reduced. The effect of this reduction in wear is particularly evident if the hammer action is deactivated, for example by switching hammer mode off, and the piston does not move for a sustained period.

A groove base is at the greatest distance from the cylinder in an area axial relative to the axis of rotation of a cross sectional profile of the radial groove where the groove is deepest. Smaller distances then exist axially adjacent thereto If the annular seal is located in the area where the distance from the cylinder is greatest, the force pressing it against the cylinder is smaller, so that the friction between the radial groove the cylinder is reduced for drilling action without hammer mode. On the other hand, if the annular seal is located in an axial area of the cross sectional profile that is less distant from the cylinder, the pressure forcing the annular seal against the cylinder increases, which increases the insulating effectiveness of the seal and is consequently associated with improved performance of the hammer drill in hammer mode.

It is particularly advantageous to provide the cross sectional profile of the radial groove parallel to the axis of rotation with an area at a smaller distance from the cylinder on either side of the area at the greatest distance from the cylinder. The advantage of this construction is that the annular seal is widened outside the middle area at the greatest distance, and consequently it is biased radially inwards, so that the annular seal tends to move towards the middle area at the greatest distance automatically. This may occur especially when hammer mode is switched off and when the spindle is stationary. When the piston is not moving but the spindle is rotating, the movement of the annular seal towards the middle area at the greatest distance is further encouraged, with the result that the annular seal automatically migrates to the area at the greatest distance, where the least friction arises between the annular seal and the cylinder, when the piston is stationary. On the other hand, if hammer mode is activated the reciprocating movements of the piston cause the annular seal to move out of the middle area and into one of the other areas at a smaller distance depending on the direction of the stroke. This relative movement between the annular seal and the radial groove may be supported by inertial forces on the one hand and favoured on the other by the friction that is generated between the annular seal and the cylinder. In other words, when the piston is moving, that is to say when hammer action is activated, the annular seal automatically assumes the positions within the radial groove that are less distance from the cylinder, which increases its sealing effect and thus also the effectiveness of the hammer mechanism.

According to one advantageous embodiment, the cross sectional profile of the radial groove may be created symmetrically about a plane of symmetry extending perpendicularly to the axis of rotation. The area at the greatest distance is then located in the middle of the cross sectional profile of the radial groove, and the two adjacent end areas are of equal size. This results in essentially the same effects for the annular seal for both stroke directions of the piston.

According to another advantageous embodiment, the maximum distance may be of equal or greater size than a maximum diameter of the annular seal's cross section measured between the groove base and the cylinder, to the extent possible in consideration of production tolerances. In other words, the maximum distance is adjusted to the annular seal in such manner that the annual seal is in force-free contact with the cylinder, or does not contact it at all when it is located in the axial area of maximum distance. Friction is thus minimised.

Further important features and advantages of the inventions are explained in the subordinate claims, the drawing, and the associated description of the figures with reference to the drawing.

Of course, the features described in the preceding and those that will be explained in the remainder of this document may be implemented not only in the combination cited in each case, but also in other combinations or alone without exceeding the scope of the present invention.

BRIEF DESCRIPTION OF THE DRAWINGS

Preferred embodiments of the invention are illustrated in the figures and will be explained in greater detail in the following description, in which the same reference numbers are used to refer to identical, or similar, or functionally equivalent components.

In the drawing, all figures of which are schematic in nature

DETAILED DESCRIPTION

Figure 1:
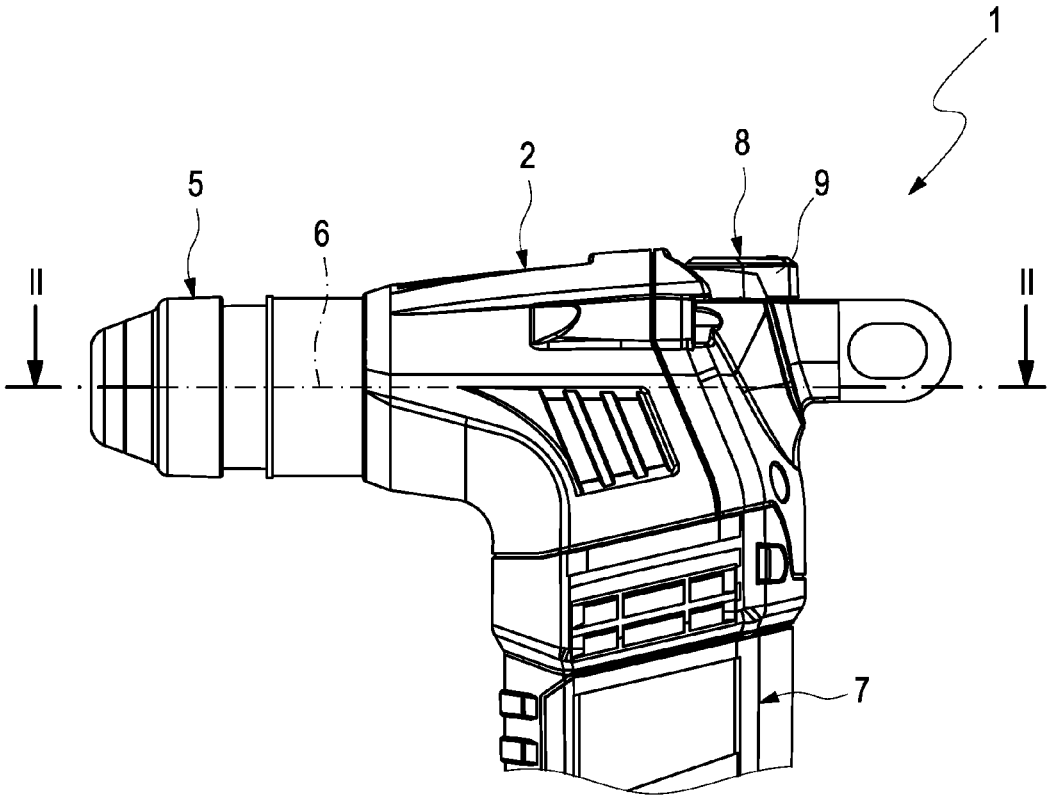
FIG. 1 is a side view of a part of a manually operated hammer drill.
Figure 2:
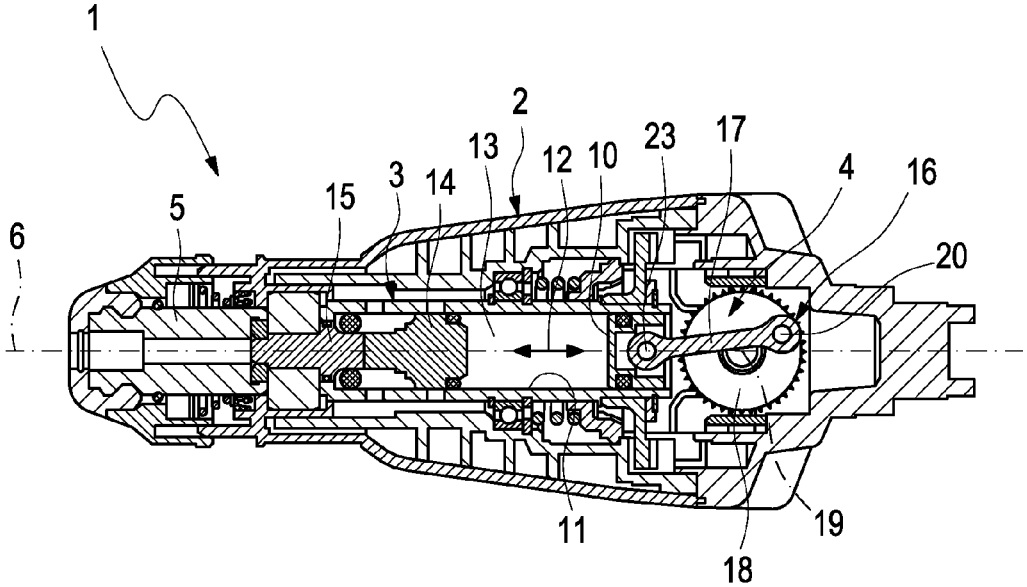
FIG. 2 is a cutaway view of a hammer drill along line II in FIG. 1.

According to FIGS. 1 and 2, a manually operated hammer drill 1, of which only a part is shown here, comprises a spindle 3 and a pneumatic hammer mechanism 4 inside a housing 2. In drilling mode, spindle 3 serves to drive a chuck 5. In drilling mode, chuck 5 and spindle 3 rotate about an axis of rotation 6. In FIGS. 1 and 2, axis of rotation 6 lies in section plane II-II. Spindle 3 itself is coupled in driving manner for example with an electric motor 7 indicated in FIG. 1, which is disposed in a separate section of housing 2, but has been omitted here for the sake of simplicity.

In hammer mode, hammer mechanism 4 serves to hammer against a tool, not shown here, which is inserted in chuck 5 for this purpose. Hammer drill 1 may be equipped preferably with a hammer action deactivation switch 8 for activating and deactivating hammer mechanism 4. This switch may comprise for example a manually operable switching element 9 with hammer mode may be switched on and off. To do this, for example, hammer action deactivation switch 8 appropriately interrupts a drive path between electric motor 7 and hammer mechanism 4, for example via a coupling.

As shown in FIG. 2, hammer mechanism 4 includes a piston 10, which in hammer mode performs reciprocating movements parallel to axis of rotation 6 inside a cylinder 11. Cylinder 11 is conformed in spindle 3. Spindle 3 is constructed as a hollow cylinder for this purpose. When the hammer mechanism is switched on, piston 10 performs oscillating movements back and forth as indicated by double-headed arrow 12, which movements create pressure pulses in a pressure transmitting chamber 13 in cylinder 11. These pressure pulses are then transmitted to a transfer piston 14. This transfer piston 14 is thus also caused to execute oscillating back and forth movements parallel to axis of rotation 6. In the process, transfer piston 14 strikes a percussion piston 15. Finally, percussion piston 15 in turn beats against the tool inserted in chuck 5.

To provide oscillating drive of piston 10, hammer mechanism 4 may include a crank drive 16, which couples piston 10 with a drive wheel 18 via a connecting rod 17, and when hammer mode is activated the drive wheel rotates about an axis of rotation 19 perpendicular to axis of rotation 6 and entrains a driving pin 20 arranged eccentrically with respect to axis of rotation 19 to drive connecting rod 17. Connecting rod 17 is coupled in non-rotating manner with piston 10. When hammer mode is deactivated, piston 10 does not perform a reciprocating motion, and remains stationary relative to axis of rotation 6. The rotary lock between connecting rod 17 and piston 10 is assured for example by means of a bolt 23, with which connecting rod 17 is connected to piston 10. In the cutaway views of FIGS. 3-5, the sectional plane has been rotated through 90° compared with the sectional plane of FIG. 2, so that the coupling between connecting rod 17 and piston 10 via bolt 23 may be seen more clearly.

As shown in FIGS. 3-6, an exterior side of piston 10 facing towards cylinder 11 is furnished with a closed radial groove 21, which extends circumferentially relative to axis of rotation 6, and in which an annular seal 22 is inserted.

Figure 6:
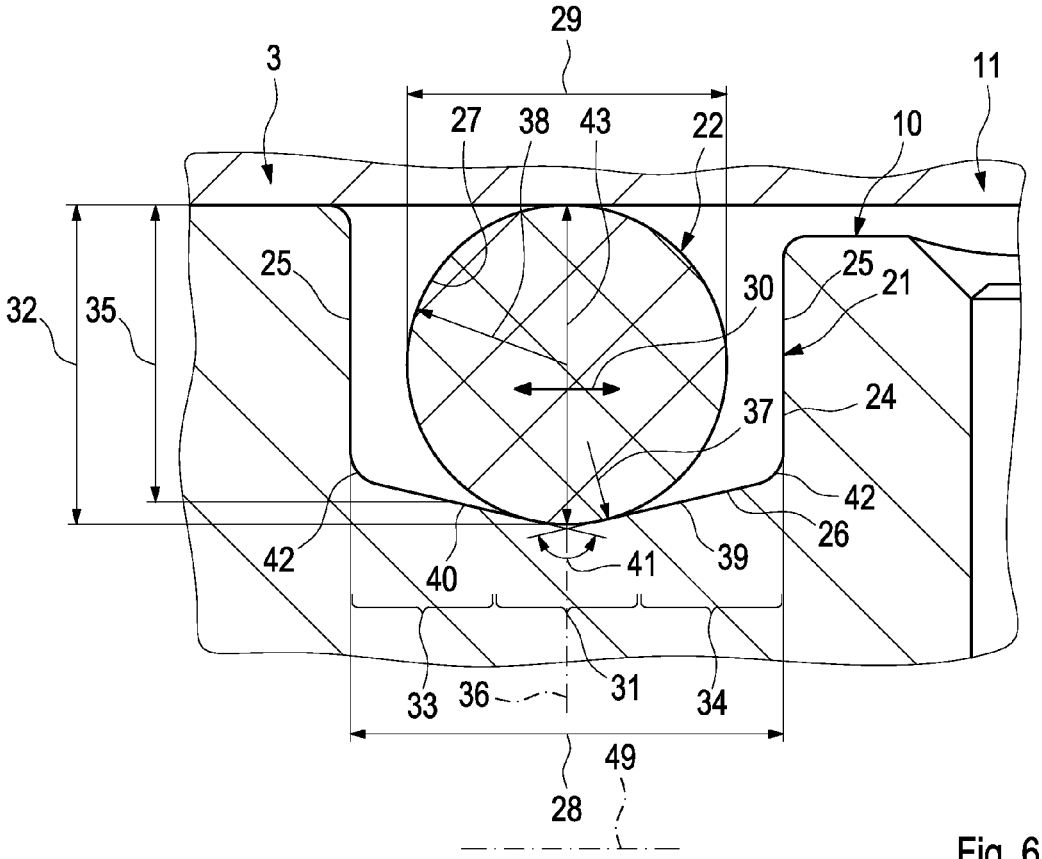
FIG. 6 is an enlarged detail VI of the piston of FIG. 3 in the area of a radial groove.

As shown in the detail view of FIG. 6, radial groove 21 has a cross-sectional profile 24 that is essentially U-shaped. This cross-sectional profile 24 lies in a cross-sectional plane that includes axis of rotation 6. Cross-sectional profile 24 has two sidewalls 25 and a groove base 26. In the example, the two sidewalls 25 are largely flat, and each lies in a plane extending perpendicularly to axis of rotation 6. Annular seal 22 also has a cross-sectional profile 27. In the example, this cross-sectional profile 27 is essentially circular in shape. Accordingly, annular seal 22 is preferably an O-ring.

In an axial direction 49 extending parallel to axis of rotation 6, indicated in FIG. 6 by a dashed-and-dotted line, cross-sectional profile 24 of radial groove 21 has a groove width 28 that is greater than a width 29 of cross-sectional profile 27 of annular seal 22, also measured parallel to axis of rotation 6. As a result, annular seal 22 is displaceable axially, that is to say parallel to axis of rotation 6, within radial groove 21, as is indicated by double-headed arrow 30 in FIG. 6.

Groove base 26 of the cross-sectional profile 24 of radial groove 21 has an axial area 31 in which the groove base 26 is at a maximum distance 32 from cylinder 11. Groove base 26 also has at least one further axial area 33, 34 in which groove base 26 has at least one smaller distance 35 from cylinder 11, that is to say at least one distance 35 that is smaller than maximum distance 32.

In the preferred example shown in FIG. 6, cross-sectional profile 24 of radial groove 21 parallel to axis of rotation 6 has one area 33 and 34 with at least one smaller distance 35 from the cylinder on either side of the area 31 with the greatest distance 32 from the cylinder. Accordingly, the one area 31 including the point of greatest distance 32 is located between the two other areas 33, 34, and in the following text this will also be referred to as middle area 31, while the other areas will also be referred to as end areas 33, 34.

The preferred configuration of radial groove 21 and the cross-sectional profile 24 thereof is the symmetrical configuration shown in FIG. 6. In the example, cross-sectional profile 24 of radial groove 21 is conformed symmetrically about a plane of symmetry 36 extending perpendicularly to axis of rotation 6. Additional, optional features also shown in FIG. 6. For example, middle area 31 of groove base 26 is curved in concave manner towards annular seal 22. In particular, an arcuate curvature may be provided here. In this case, it is particularly advantageous to select a radius of curvature 37 of this curved middle area 31 such that it is larger than the circular radius 38 of the circular cross-sectional profile 27 of annular seal 22.

On the other hand, end areas 33, 34 are preferably shaped such that at least the essential sections thereof are straight. These straight sections are designated in FIG. 6 by the numbers 39 and 40. Between them, straight sections 39, 40 of end areas 33, 34 form an obtuse angle 41, which is particularly greater than 120° and may be for example 150°±10°. Expediently, straight section 39, 40 of end areas 33, 34 merge tangentially into curved middle area 31. A transition 42 describing an arch, particularly a circular arc, into straight sides 25 of cross-sectional profile 24 of the radial groove 21 is also provided here in end areas 33, 34.

FIG. 6 shows a further optional feature. In FIG. 6, annular seal 22 is arranged in the middle area 31 of radial groove 21. Accordingly, it is located in the area of radial groove 21 at which the groove is deepest, that is to say it has the maximum distance 32 from the cylinder. According to a preferred configuration, this maximum distance 32 may be selected to be of the same size as a diameter 43 of cross section 27 of annular seal 22, this diameter 43 of cross section 27 of annular seal 22 being measured parallel to the distance between groove base 26 and cylinder 11. Diameter 48 is measured parallel to distance 32, since the originally circular cross-section of annular seal 22 is deformed in more or less oval or elliptical manner by radial tension that may even be present in the condition shown in FIG. 6. Since production of both the radial groove 21 and the annular seal 22 is contingent on manufacturing tolerances, the formulation "of equal size" is to be understood to mean effectively that maximum distance 32 is of equal size to diameter 43 with allowance being made for typical production tolerances. Deviations may therefore occur as a result of tolerances and should also be included. In the special embodiment suggested here, annular seal 22 is in practically force-free contact with cylinder 11, or even does not contact it at all. Consequently, there is minimal friction between annular seal 22 and cylinder 11 when piston 10 is not moving and spindle 3 is rotating. It is also possible to select maximum distance 32 to be greater than diameter 43 of annular seal 22.

In the example, cross-sectional profile 24 of radial groove 21 is at least 20% larger in the axial direction 49, that is to say parallel to axis of rotation 6, than cross-sectional profile 27 of annular seal 22 in the same direction, that is to say parallel to axis of rotation 6. It is helpful if the cross-sectional profile 24 of radial groove 21 parallel to axis t of rotation 6 is 50% larger than the cross-sectional profile 27 of annular seal 22.

Figure 7:
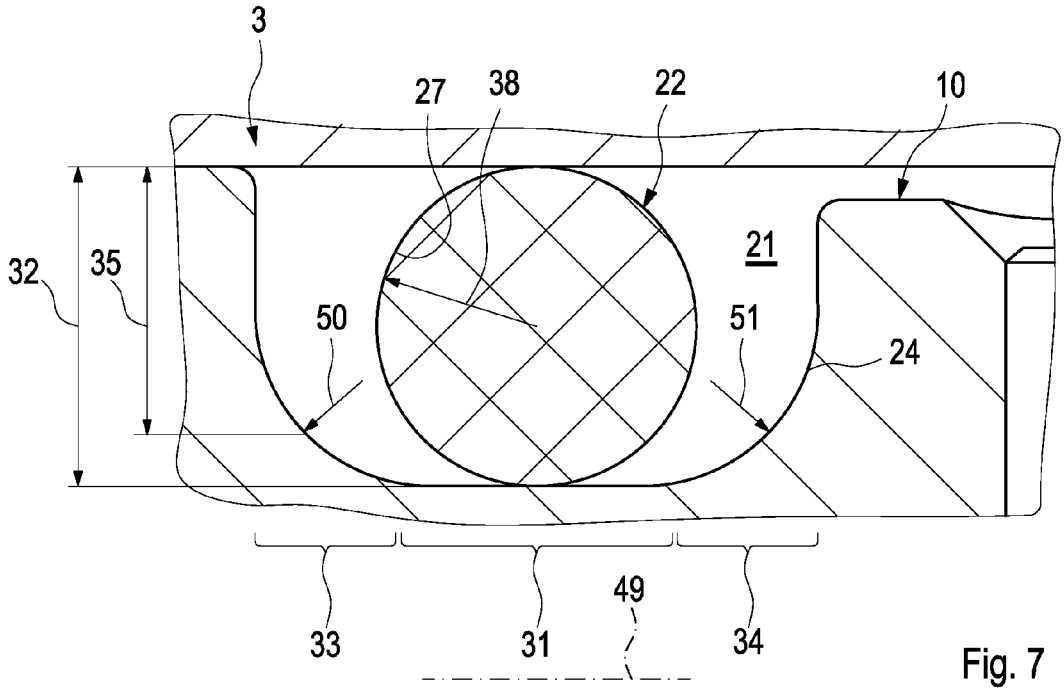
FIG. 7 is a cutaway view as in FIG. 6, but considerably simplified and of another embodiment.

In the embodiment shown in FIG. 7, middle area 31 is conformed in such manner that it extends in a straight line and parallel to axial direction 49, and thus parallel to axis of rotation 6. In this respect, the middle area 31 of radial groove 21 has a constant section in axial direction 49 in cross-sectional profile 24. The two end areas 33, 34 are curved and merge tangentially with the straight middle area 31. In particular, the curvature of end areas 33, 34 may be that of an arc of a circle, wherein each then has a radius 50 and 51. It is advantageous if the two radii 50, 51 are of equal size; however, they that also be of different sizes. The respective radius 50, 51 is greater than the radius 38 of cross-sectional profile 27 of annular seal 22 that is present at least when annular seal 22 is not subjected to any stress. End sections 33, 34 thus form ramps, along which annular seal 22 is raised radially outwardly when annular seal 22 moves from the middle area 31 to one of the end areas 33, 34 in radial groove 21.

In order to supply electrical power to electric motor 7, hammer drill 1 may be connected to a mains power supply via a cable not shown here. It is also possible to equip hammer drill 1 with a rechargeable battery which allows hammer drill 1 to be operated independently of a mains power supply. Such a rechargeable battery is not shown in FIG. 1, however. It is normally attached to the bottom of housing 2 with reference to the illustration of FIG. 1.

Figure 3:
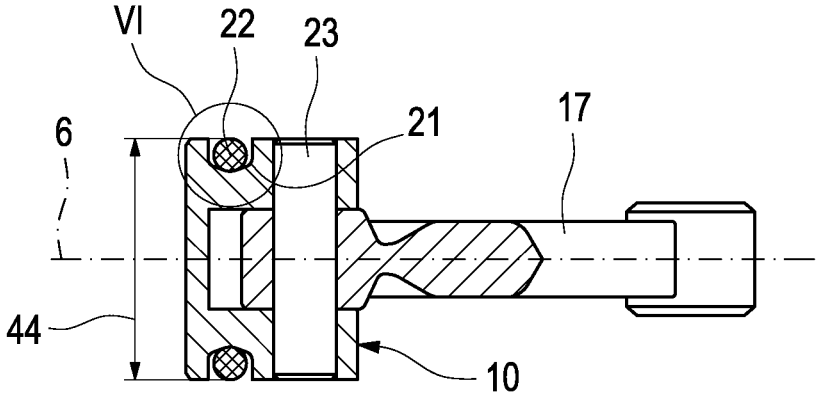
FIGS. 3-5 each show a longitudinal section through a piston in a hammer mechanism in various operating conditions.
Figure 4:
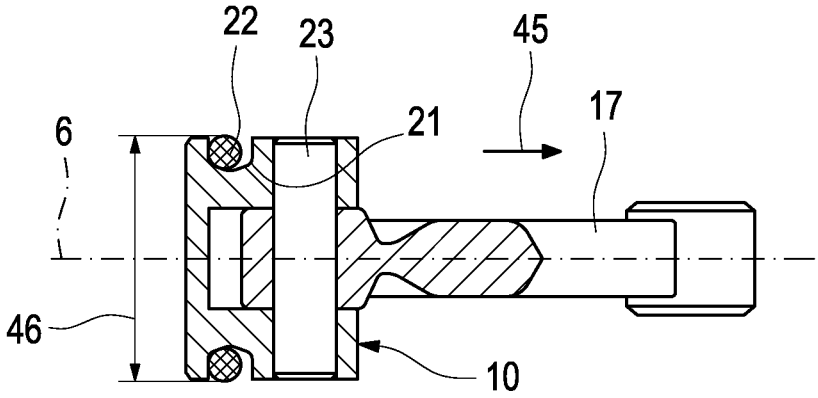
Figure 5:
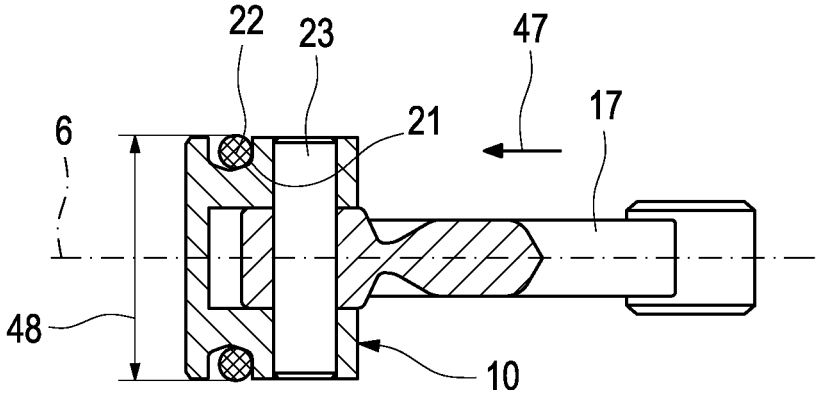

With reference to FIGS. 3-5, the mode of operation of the hammer drill 1 described here and of the special design of radial groove 21 will be described in greater detail in the following.

FIG. 3 represents an operating state in which hammer mode has been deactivated by means of hammer action deactivation switch 8. Consequently, piston 10 does not perform any reciprocating movements relative to cylinder 11; piston 10 does not move. In this case, annular seal 22 positions itself automatically in middle area 31 in radial groove 21, which represents the maximum distance 32 from the cylinder. Accordingly, annular seal 22 has a minimum outer diameter 44, which creates minimal friction against rotating spindle 3. When hammer mechanism 4 is deactivated, annular seal 22 assumes this middle position automatically, because end areas 33, 34 function in the manner of ramps to centre annular seal 22 in middle area 33. Annular seal 22 is also predisposed in this direction by the internal prestress load of annular seal 22, which acts on the seal when it is expanded by the ramp effect in end areas 33, 34. This state as shown in FIG. 3 may also occur when hammer mode is activated, every time piston 10 passes through one of its dead points prior reversing its direction of travel and is temporarily motionless.

FIGS. 4 and 5 reflect states that occur when piston 10 performs reciprocating movements. This is the case when hammer mode is activated via hammer action deactivation switch 8, and hammer mechanism 4 has been switched on. These reciprocating movements then occur between the dead points of piston 10, that is to say the piston movement.

FIG. 4 shows the situation during a stroke 45 away from chuck 5. Inertial forces and/or friction between annular seal 22 and cylinder 11 then cause annular seal 22 to be displaced axially within radial groove 21 in the opposite direction to stroke 45, so that it is moved into area 33, which faces towards chuck 5. In FIG. 4, stroke 45 is directed to the right, causing annular seal 22 to be moved into left end area 33. Then, it comes to rest flush with the left sidewall 25 of radial groove 21. This the smaller distance 35 is effective in this end area 33, annular seal 22 expands radially, so that its external diameter 46 is greater than the external diameter 44 of the annular seal 22 shown in FIG. 3 when piston 10 is stationary.

On the other hand, FIG. 5 shows the situation for a stroke 47 directed towards chuck 5. The dominant forces acting on annular seal 22 now displace annular seal 22 in a direction away from chuck 5 within radial groove 21, that is to say, in the opposite direction to stroke 47 again. In FIG. 5, stroke 47 is directed towards the left. Accordingly, annular seal 22 moves to the right within radial groove 21, that is to say into the end area 34 on the right. Here too, the reduced distance 35 in end area 34 causes annular seal 22 to expand radially, so again it has a diameter 48. This diameter 48 is also larger than the diameter 44 shown in FIG. 3, which exists when piston 10 is not moving. It is advantageous if both larger diameters 46 and 48 are the same size, which occurs particularly if radial groove 21 is conformed symmetrically.

The larger diameters 46, 48 that the annular seal assumes automatically in hammer mode increase the force with which annular seal 22 is pressed against cylinder 11, thereby improving the sealing effect and thus also the performance capability of hammer mechanism 4 and accordingly hammer drill 1.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A manually operated hammer drill comprising:

a spindle (3) that drives a chuck (5) in a rotary manner about an axis of rotation (6) in a drilling mode, a pneumatic hammer mechanism (4), that hammers against a tool inserted in the chuck (5) in a hammer mode, wherein the hammer mechanism (4) has a piston (10) which performs reciprocating movements (12) parallel to the axis of rotation (6) in a cylinder (11) conformed inside the spindle (3) when the hammer mode is activated, wherein the piston (10) has at least one radial groove (21) in which an annular seal (22) is arranged, and the radial groove (21) has a cross-sectional profile (24) that is larger parallel to the axis of rotation (6) than a cross-sectional profile (27) of the annular seal (22) and which is furnished with a middle area (31) disposed midway within the radial groove at the groove base (26) that is at a maximum distance (32) from the cylinder (11) and end areas (33, 34) that taper radially outward from the middle area (31) and are at a smaller distance (35) from the cylinder (11), than the maximum distance (32).

2. The hammer drill as recited in claim 1, wherein the cross-sectional profile (24) of the radial groove (21) parallel to the axis of rotation (6) has the end areas (33, 34) each at smaller distances (35) on either side of the middle area (31) that has the maximum distance (32).

3. The hammer drill as recited in claim 2, wherein the cross-sectional profile (24) of the radial groove (21) is conformed symmetrically relative to a plane of symmetry extending perpendicularly to the axis of rotation (6).

4. The hammer drill as recited in claim 1, including due consideration for production tolerances, the maximum distance (32) is of equal or greater size than a maximum diameter (43) of the cross-section (27) of the annular seal (22) measured parallel to the distance from the cylinder.

5. The hammer drill as recited in claim 1, wherein the middle area (31) having the maximum distance (32) has a concave curvature towards the annular seal (22), and the middle area (31) includes the maximum distance (32) that is curved in the form of a arc of a circle having an arc radius (37) that is larger than a circular radius (38) of the circular cross-sectional profile (27) of the annular seal (22).

6. The hammer drill as recited in claim 1, wherein the middle area (31) having the maximum distance (32) extends in a straight line parallel to the axis of rotation (6).

7. The hammer drill as recited in claim 1, wherein each of the areas (33, 34) include the smaller distance (35) is straight or has a straight section (39, 40), or each of the end areas (33, 34) include the smaller distance (35), is curved, in particular arcuate, or has a section that is curved, in particular arcuate.

8. The hammer drill as recited in claim 1, wherein each of the end areas (33, 34) having the smaller distance (35) merges tangentially with the middle area (31) having the maximum distance (32).

9. The hammer drill as recited in claim 1, wherein the cross-sectional profile (24) of the radial groove (21) parallel to the axis of rotation (6) is at least 20% and up to 50% larger than the cross-sectional profile (27) of the annular seal (22).

10. The hammer drill as recited in claim 1, including a rechargeable battery to supply electrical power to an electric motor (7) for driving one of the spindle (3) and the hammer mechanism (4).

11. The hammer drill as recited in claim 1, including a hammer action deactivation switch (8) to enable drilling mode without hammer action.

12. The hammer drill as recited in claim 1, wherein the middle area (31) is disposed midway between axially facing walls of the radial groove (21).

13. The hammer drill as recited in claim 1, wherein the annular seal (22) protrudes from the radial groove (21) a minimum radial distance when within the middle area (31).

14. The hammer drill as recited in claim 1, wherein the annular seal (22) is raised radially outward responsive to movement away from the middle area (31).

15. The hammer drill as recited in claim 1, wherein the middle area (31) comprises a flat surfaces parallel with the axis of rotation (6).

* * * * *